US005500716A

United States Patent [19]

Morishita et al.

[11] Patent Number: 5,500,716

[45] Date of Patent: Mar. 19, 1996

[54] IMAGE FORMING APPARATUS WHICH DETECTS WASTE TONER ACCUMULATION BEFORE PHOTOCONDUCTIVE SERVICE LIFE EXPIRATION

[75] Inventors: Hiroki Morishita; Susumu Taniguchi; Shinichi Kotera, all of Osaka, Japan

[73] Assignee: Mita Industrial Co., Ltd., Osaka, Japan

[21] Appl. No.: 400,815

[22] Filed: Mar. 8, 1995

[30] Foreign Application Priority Data

Mar. 15, 1994 [JP] Japan ..... 6-044221

[51] Int. Cl.[6] ..... G03G 15/00; G03G 21/10

[52] U.S. Cl. ..... 355/206; 355/298

[58] Field of Search ..... 355/298, 296, 355/208, 246, 206, 260

[56] References Cited

U.S. PATENT DOCUMENTS 4,791,454 12/1988 Takahashi et al. ..... 355/260 X 5,008,711 4/1991 Sakamoto et al. ..... 355/298

FOREIGN PATENT DOCUMENTS 5173457 7/1993 Japan ..... 355/298

*Primary Examiner*—Joan H. Pendegrass

*Assistant Examiner*—Sophia S. Chen

*Attorney, Agent, or Firm*—Beveridge, DeGrandi, Weilacher & Young

[57] ABSTRACT

An image forming apparatus including a cleaning unit wherein a storage is defined in a cleaning housing to store therein toner to be discarded which is collected from the surface of a photoconductive drum after image transfer. The aforesaid storage has a capacity exceeding the maximum volume of toner to be used under normal conditions within the service life of the photoconductive drum. A cumulative number of produced copies is found from a signal from a paper discharge detecting sensor, so that with the number reaching a certain value, it is judged that the life of the photoconductive drum has expired. If a reed switch detects that the storage is full of waste toner before the expiry of the life of the photoconductive drum, it is judge to be abnormal, and a display unit is caused to indicate abnormality. Concurrent execution of the exchange of photoconductive drums and disposal of toner waste is assured, and if this is not accomplished, warning for trouble shooting is provided.

3 Claims, 8 Drawing Sheets

IMAGE FORMING APPARATUS WHICH DETECTS WASTE TONER ACCUMULATION BEFORE PHOTOCONDUCTIVE SERVICE LIFE EXPIRATION

CROSS REFERENCE TO RELATED APPLICATION

This application claims priority benefits under 35 U.S.C. §119 of Japanese Patent Application No. 6-44221, the disclosure of which is incorporated herein by reference.

BACKGROUND OF THE INVENTION

1. Field of the Invention

The present invention relates to an image forming apparatus such as an electrophotographic apparatus, information recording apparatus or the like.

2. Description of Related Art

Conventionally the image forming apparatus of this type is adapted to store in a toner collecting box, toner to be discarded (hereinafter referred to as toner waste) which is collected by a cleaning unit from the surface of a photoconductive drum after image transfer and thence before the toner collecting box becomes full, it must be detected timely by proper detecting means so that the toner waste may be discarded from the apparatus.

If the capacity of the toner collecting box is set regardless of the service life of the photoconductive drum, disposal of the toner waste and exchange of the photoconductive drums are carried out at different times, resulting in more frequent maintenance services being needed.

To avoid such a problem, it is preferable that the toner collecting box is adapted to become full just as the photoconductive drum ends its service life.

Recently, there are increasing instances where images of photographs or other graphic originals are transferred. The volume of toner to be used varies significantly depending on the frequencies of transfer of the graphic originals. Accordingly, it is impracticable to arrange the toner collecting box to become full simultaneously with the expiry of the service life of the photoconductive drum.

If the capacity of the toner collecting box should be designed such that the toner collecting box becomes full just as the photoconductive drum ends its service life under given operational conditions, the toner collecting box would often become full before exchanging the photoconductive drums because the use of toner is within a range of normal operations but beyond the range of the aforesaid given operational conditions. Additionally, there are some actual cases where the volume of toner collected by a toner collector is abnormally large due to the occurrence of some abnormality.

SUMMARY OF THE INVENTION

It is, therefore, an object of the present invention to provide an image forming apparatus which not only assures under normal operational conditions that the exchange of photoconductive materials and the disposal of collected toner can be carried out simultaneously but also enables it to give a warning of abnormality in the process if this cannot be attained.

To accomplish the above object, an image forming apparatus according to one embodiment of the present invention which employs a photoconductive material having a predetermined service life comprises a toner collecting box in which toner waste removed by cleaning from the photoconductive material after image transfer is collected and the capacity of which exceeds the maximum volume of toner to be used under normal operational conditions within the service life of the photoconductive material, life expiry detecting means for detecting that the photoconductive material has ended its service life, fullness detecting means for detecting that the toner collecting box is full of toner and abnormality warning means for indicating an abnormality when the fullness detecting means detects that the collecting box is full before the life expiry detecting means detects the expiry of the service life of the photoconductive material.

According to the embodiment of the invention, the toner collecting box has a capacity exceeding the maximum volume of toner to be used under normal operational conditions within the service life of the photoconductive material, and hence the toner collecting box does not become full before exchanging the photoconductive materials. Accordingly, it is ensured that the exchange of the photoconductive materials and the disposal of collected toner can be conducted at the same time.

Further, the toner collecting box has a capacity exceeding the maximum volume of toner to be used under normal operational conditions within the service life of the photoconductive material, and therefore, if the fullness detecting means should detect that the toner collecting box is full of toner before the life expiry detecting means detects the expiry of the service life of the photoconductive material, such a state will be judged to be abnormal and the abnormality warning means will be caused to indicate abnormality. In response to this, an operator can take a proper measure, e.g., calling a service man.

DETAILED DESCRIPTION OF THE PREFERRED EMBODIMENTS

An embodiment of the present invention will be described in detail with reference to the accompanying drawings.

Figure 1:
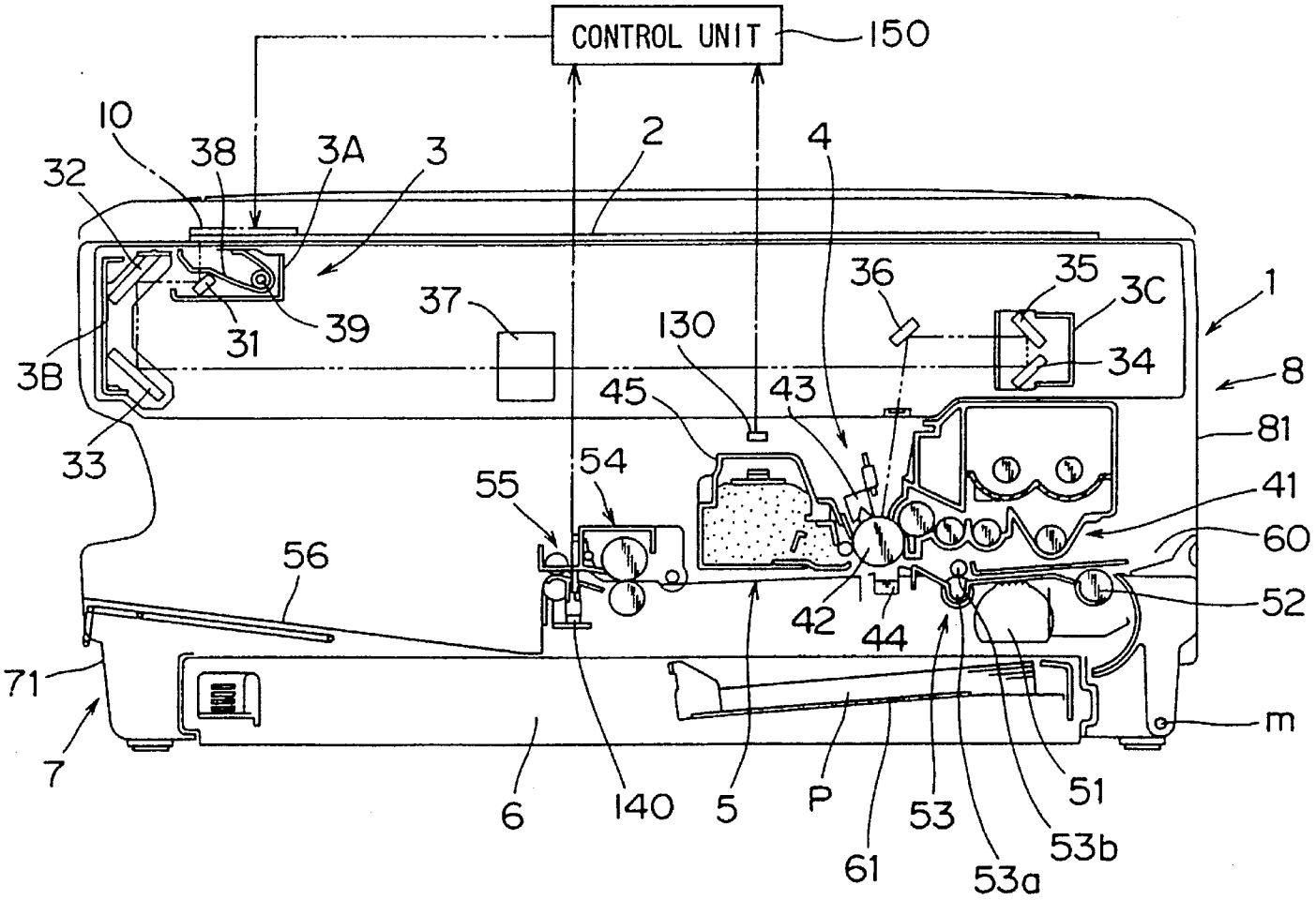
FIG. 1 is a schematic view in section illustrating a copying machine as an image forming apparatus according to one embodiment of the present invention.

An image forming apparatus as an embodiment of the present invention is applicable, for example, to a copying machine as shown in FIG. 1. Now referring to the figure, the main body of the copying machine 1 includes therein (1) an optical system 3 for illuminating and scanning an original placed on a transparent platen 2 and focusing image rays reflected from the illuminated original onto a photoconductive drum 42, (2) an image processing portion 4 wherein an latent electrostatic image produced on the photoconductive drum 42 is developed into a toner image by a developing unit 41 and thereafter the image thus developed is transferred to a sheet of copy paper, and (3) a paper transport portion 5 which draws out the aforesaid copy paper from a paper feed tray 61 in a paper containing portion 6 by means of a paper take-up roll 51 having a semi-circular form in section and conveys the paper through the image processing portion 4 to a copy tray 56 in the main body of the copying machine.

The main body 1 comprises a lower unit 7 defined by a lower casing 71, and an upper unit 8 defined by an upper casing 81 relatively pivotably supported with respect to the lower unit 7 around a predetermined pivotal axis m disposed at an end thereof. The main body 1 has a so-called clam-shell type structure wherein the upper unit 8 is openable as relatively turned with respect to the lower unit 7.

The optical system 3 illuminates a document original by means of a fluorescent lamp 39 with a reflector 38 which is secured to a first shift frame 3A, and focuses image rays reflected from the document original onto the photoconductive drum 42 sequentially thorough a first mirror 31 secured to the first shift frame 3A, a second mirror 32, a third mirror 33 and a lens 37 secured to a second shift frame 3B, a fourth mirror 34, a fifth mirror 35 and a sixth mirror 36 secured to a third shift frame 3C.

The image processing portion 4 has a drum charge corona 43, the developing unit 41, an image transfer corona 44 and a cleaning unit 45 disposed around the photoconductive drum 42 in the order named. The image processing portion 4 is adapted such that a latent electrostatic image is produced by focusing image rays reflected from the document original on the outer peripheral surface of the uniformly charged photoconductive drum 42; thereafter the latent electrostatic image thus produced is developed into a toner image by the developing unit 41; the toner image so developed is transferred to a sheet of copy paper by the image transfer corona 44; and the residual toner is recovered by the cleaning unit 45.

The paper transport portion 5 comprises the aforesaid paper take-up roll 51 for sequentially drawing out a copy paper from the paper feed tray 61, a transport roller 52 for advancing the copy paper from a manual feed portion 60 or the paper feed tray 61, a drive roller 53*a* and a driven roller 53*b* serving as resist means 53 against which the leading edge of the paper conveyed by the transport roller 52 abuts to thereby halt the paper temporarily, a fixing portion 54 for fixing the toner image transferred to the paper, and a pair of discharge rollers 55.

Figure 2:
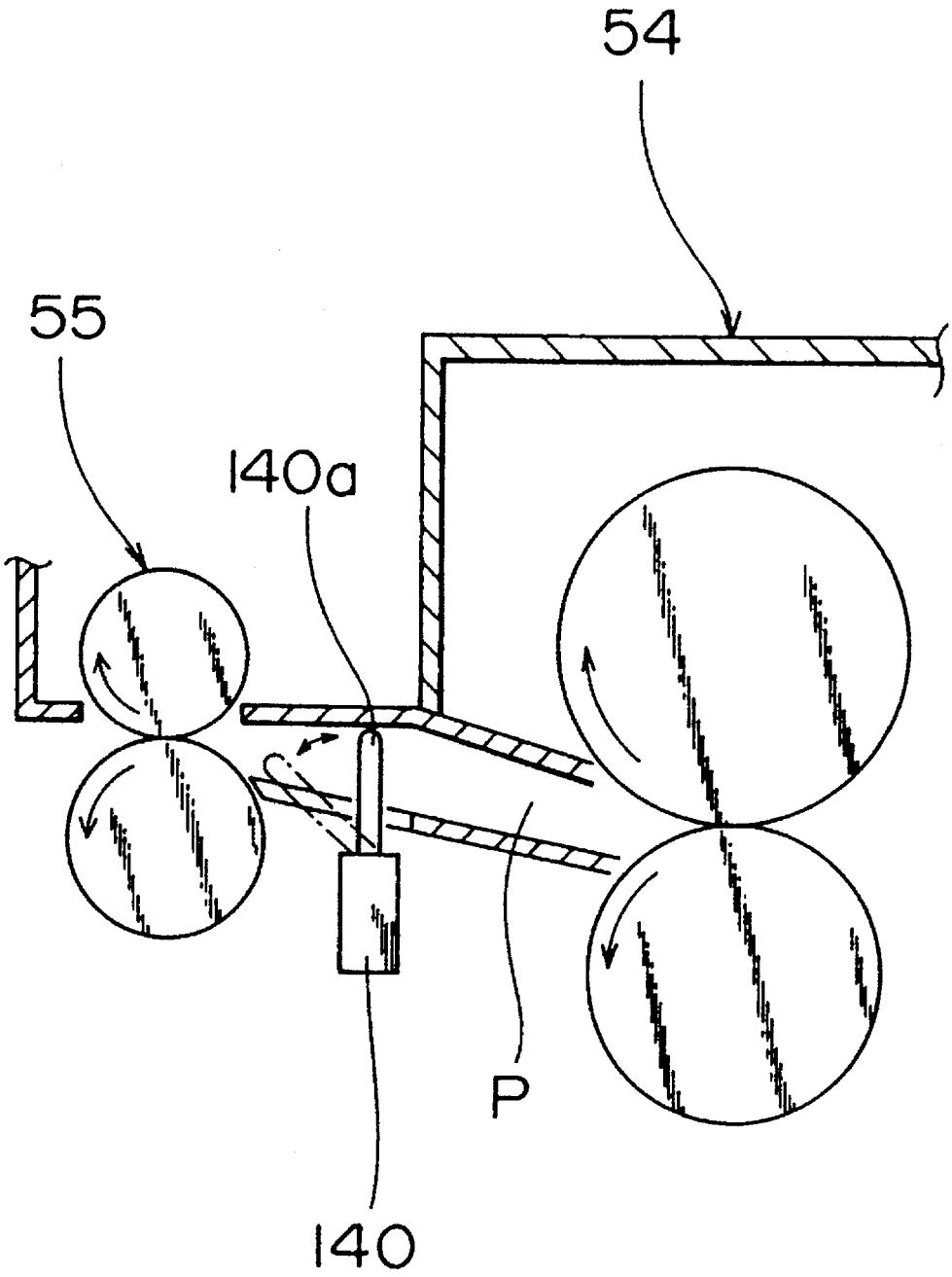
FIG. 2 is an enlarged view in section illustrating a principal part of the periphery of a fixing portion.

With reference to FIG. 2 which is an enlarged view illustrating a principal part of the vicinity of the fixing portion 54, a paper discharge detecting sensor 140 for detecting the exit of a copy paper, comprising a limit switch, is disposed between the aforesaid fixing portion 54 and the discharge rollers 55. The paper discharge detecting sensor 140 has an upright operating stick 140*a* intruding into a paper transport passage P. The operating stick 140*a* becomes in a state shown by a dashed line in the figure as tumbled by the leading edge of the paper transported along the paper transport passage P, to output an ON signal, and returns to the initial upright state responding to the passage of the trailing edge of the paper.

Figure 3:
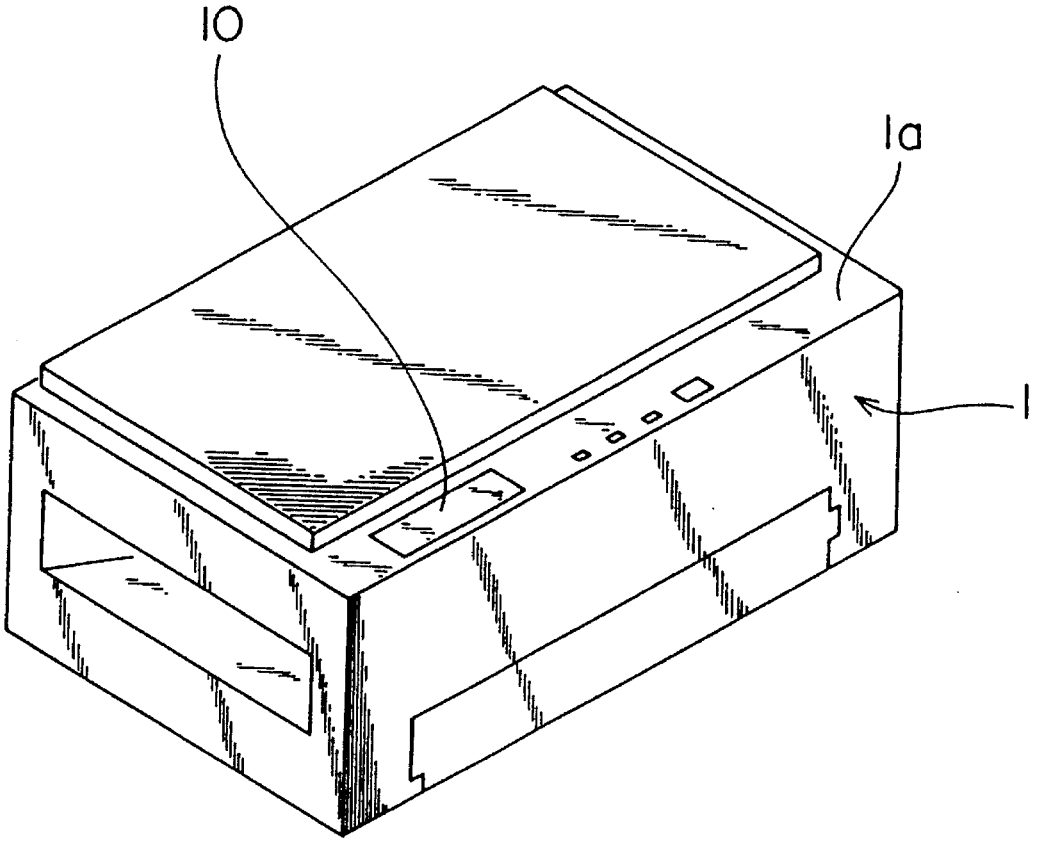
FIG. 3 is a schematic view in perspective illustrating a copying machine.

The aforesaid cleaning unit 45 has a storage 104 (see FIG. 5) for accommodating toner waste scraped off from the circumferential surface of the photoconductive drum 42. A reed switch 130 for detecting that the storage 104 is filled up with toner waste is disposed above the cleaning unit 45. Referring to FIG. 1, the output of the reed switch 130 is supplied to a control unit 150. On the other hand, the output of the aforesaid paper discharge detecting sensor 140 is supplied to the control unit 150 which multiplies the number of the aforesaid outputs as supplied, to find a cumulative number of produced copies N. (Alternatively, it may be adapted to detect a signal switched from OFF to ON as the leading edge of the paper passes the paper discharge detecting sensor 140 or a signal switched from ON to OFF as the trailing edge of the paper passes the paper discharge detecting sensor 140.) With the cumulative number of the produced copies N reaching a predetermined limit value NL (e.g. 30,000), the control unit 150 sends a signal, causing a liquid crystal display unit 10 (see FIG. 3) provided on the upper surface 1*a* of the main body 1 to display a message indicating that the photoconductive drum 42 has ended its service life. This embodiment of the present invention determines the expiry of the service life of a photoconductive drum 42 from the number of copies produced.

The embodiment of the present invention is characterized by that (1) the capacity of the aforesaid storage 104 is adapted to exceed the maximum volume of toner to be used under normal operational conditions within the service life of the photoconductive drum 42, and that (2) if the reed switch 130 detects that the storage is full before the expiry of the service life of the photoconductive drum 42, the control unit 150 sends a signal to cause the display unit 10 to show a message indicating that the use of toner is abnormally large.

Figure 4:
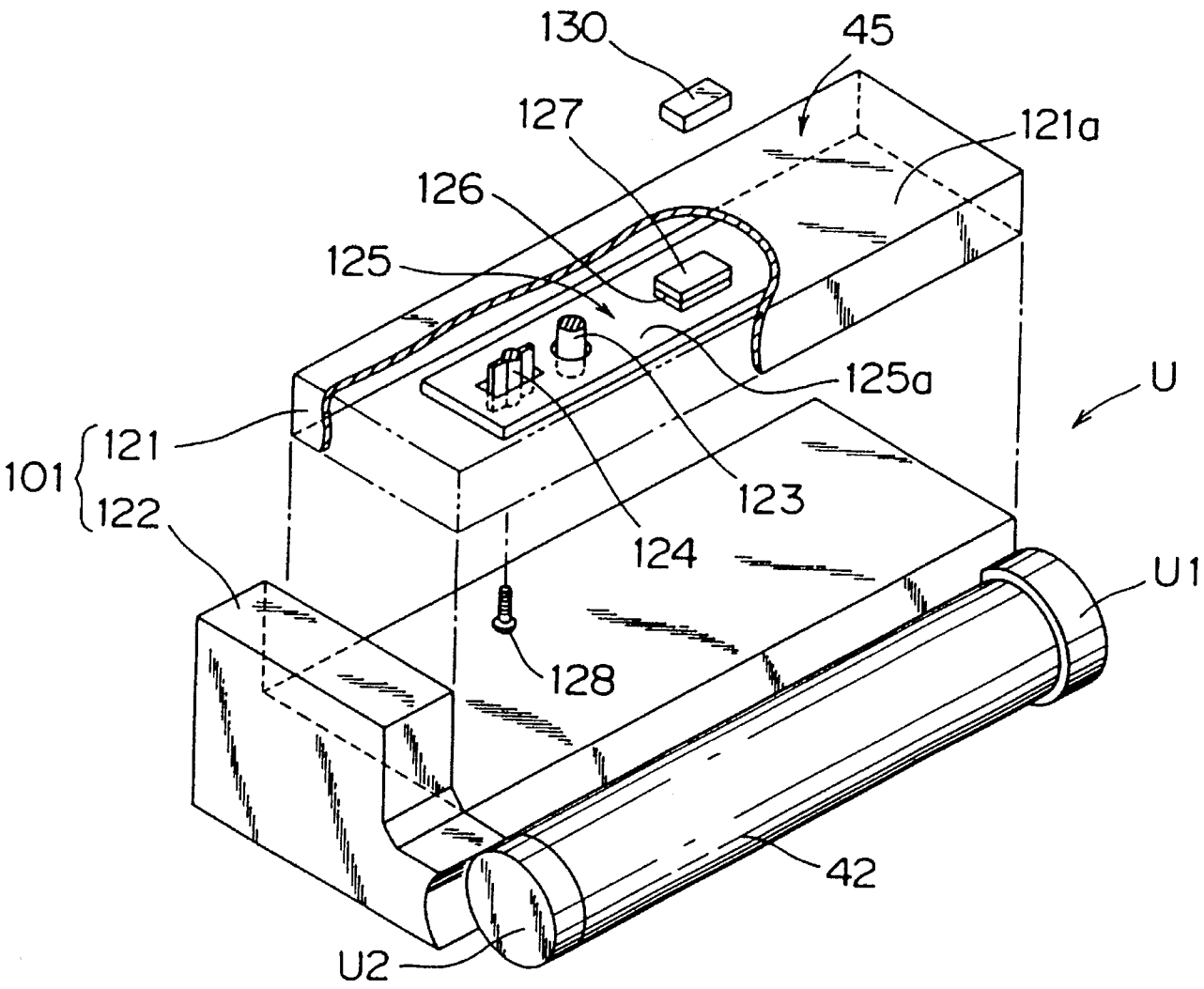
FIG. 4 is a schematic exploded view in perspective illustrating a unit which comprises a cleaning unit incorporating a toner collecting box, and a photoconductive drum.

Referring to FIG. 4, a unit U comprising the aforesaid cleaning unit 45 and photoconductive drum 42 is integrally detachable from the main body 1. The unit U has a pair of retainers U1, U2 for supporting the both ends of the photoconductive drum 42.

Figure 5:
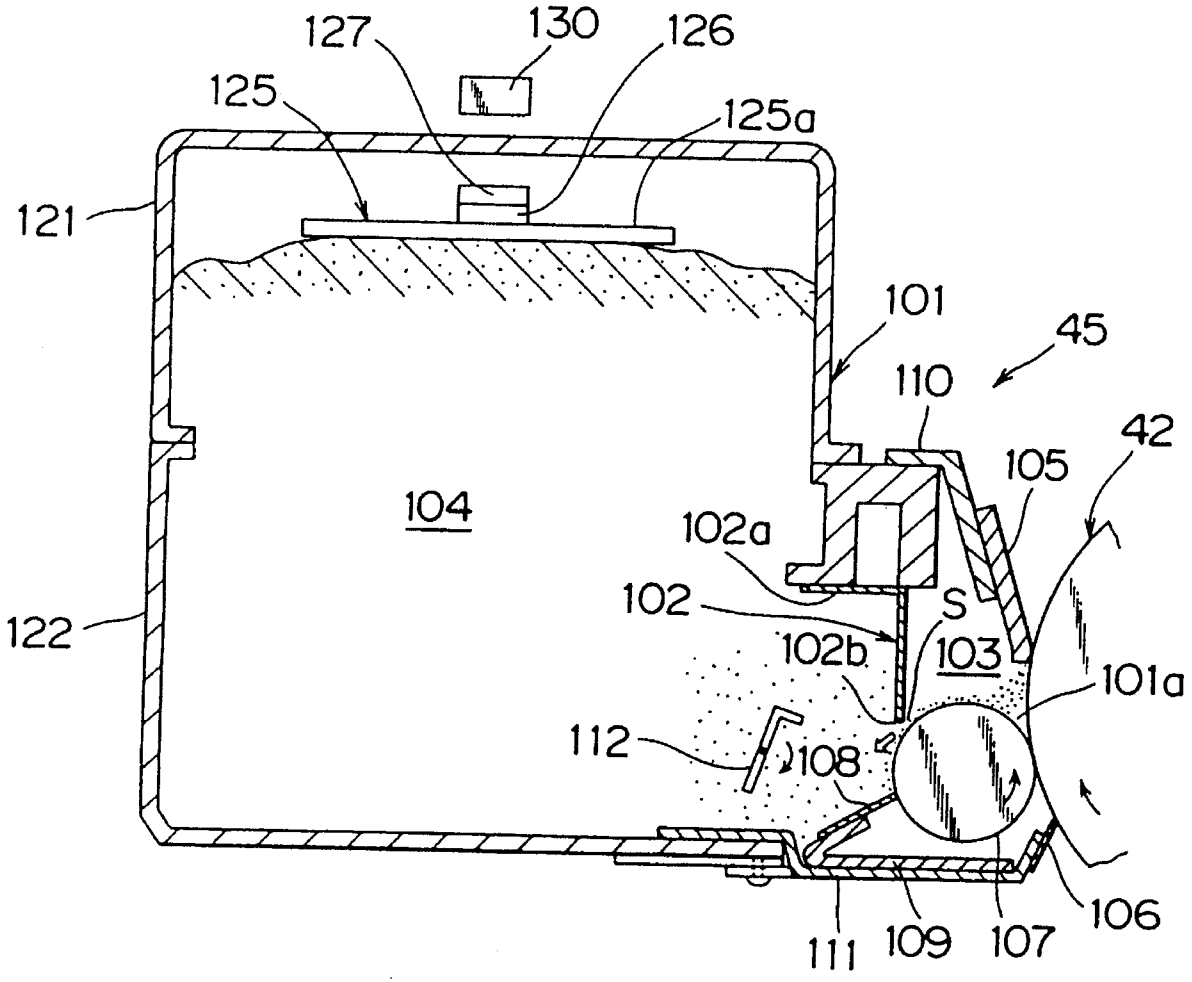
FIG. 5 is a sectional view illustrating a cleaning unit.

With reference to FIG. 5, the aforesaid cleaning unit 45 has a cleaning housing 101 including an opening 101*a* opposite to the photoconductive drum 42. The cleaning housing 101 comprises an upper housing 121 and a lower housing 122 which are removably fixed to each other by the use of screws. The interior of the cleaning housing 101 is divided by a sectionally L-shaped partition 102 into a cleaning chamber 103 for scraping toner off from the surface of the photoconductive drum 42 and the storage 104 in which the toner thus scraped off is stored. The aforesaid storage 104 of the cleaning housing 101 also serves as the toner collecting box.

Figure 6:
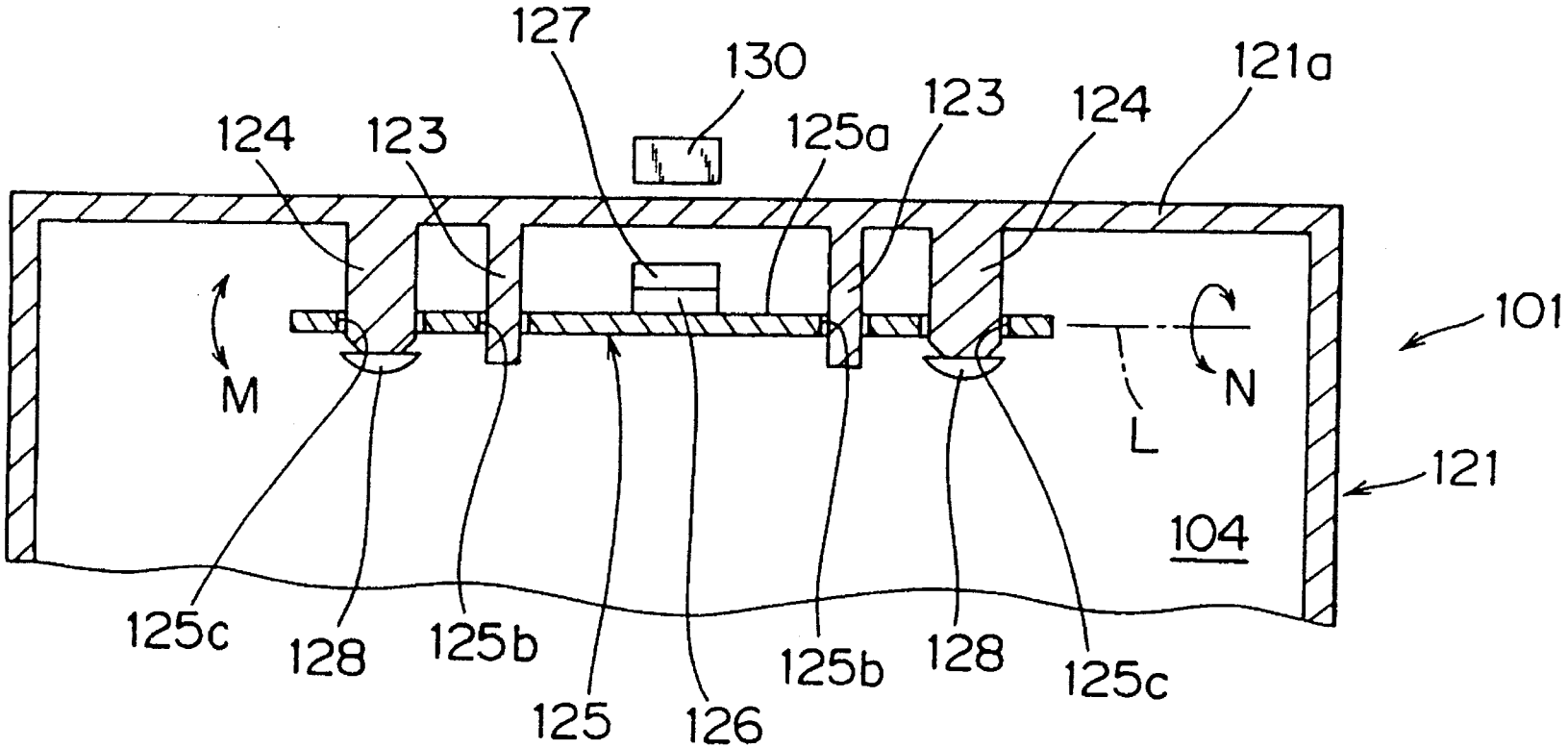
FIG. 6 is an enlarged view in section illustrating a principal part of a toner collecting box.

Referring to FIGS. 4 and 6, the aforesaid storage 104 includes therein a detecting plate 125 opposing a top plate 121*a* of the upper housing 121, vertically movably supported by two pairs of ribs 123 and 124 protruding downward from the top plate 121*a*. The detecting plate 125 comprises a thin plate made of flexible metal (e.g. aluminum) and has a permanent magnet 127 provided at the center of the upper surface 125*a* thereof by means of a sponge member 125 as a resilient supporting means having a certain level of resilience. The sponge member 126 has a rectangular parallelopiped shape, being bonded to the upper surface of the aforesaid detecting plate 125. The permanent magnet 127 has a rectangular parallelopiped shape, being bonded to the upper surface of the sponge member 126. The reed switch 130 as means for detecting the fullness of the storage and actuated in response to the magnetic force of the permanent magnet 127 is disposed at a place opposing the aforesaid permanent magnet 127, which has reached the uppermost position, with the top plate 121*a* interposed therebetween. An output of the reed switch 130 is supplied to the control unit 150 which, on receiving the aforesaid output, sends a signal to the display unit 10 thereby to cause the same to inform an operator that, for example, the storage is full.

The aforementioned ribs 123 are shaped like a column and penetrate through-holes 125*b* of the detecting plate 125. The through-holes 125*b* are opposite to each other with the aforesaid permanent magnet 127 interposed therebetween. The aforesaid ribs 124 have an elongated section extending along the longitudinal direction of the detecting plate 125 and penetrate through-holes 125*c* defined at positions opposite to each other with the aforesaid permanent magnet 127 interposed therebetween and beyond the aforesaid through-holes 125*b*. The rib 124 has a machine screw 128 threaded in the lower end thereof, thereby preventing the detecting plate 125 from dropping off from the rib 124.

With reference to FIG. 6, clearance between the through-holes 125*b*, 125*c* and the ribs 123, 124 corresponding thereto respectively is adapted such that some degree of inclination or deflection of the detecting plate 125 may be allowed. More specifically, in FIG. 6, the detecting plate 125 is allowed to swingably incline in the direction shown by the arrow M in the figure or in the direction shown by the arrow N about the longitudinal axis L of the detecting plate 125. Thus, the detecting plate 125 is imparted with such a degree of freedom as to follow an inclination of the upper surface of toner waste accumulated in the storage 104.

Referring to FIG. 5, at the upper part of the aforesaid opening 101*a* provided is a main blade 105 the lower end of which is in contact with the circumferential surface of the photoconductive drum 42. The main blade 105 is fixed to the cleaning housing 101 by way of a mounting element 110 so that in association with the rotation of the photoconductive drum 42, the aforesaid lower end thereof scrapes off toner remaining on the surface of the photoconductive drum 42. Whereas a receptive blade 106 made of rubber or the like is provided at the lower part of the opening 101*a* to cover this lower part. The upper edge of the receptive blade 106 is in close proximity to the circumferential surface of the photoconductive drum 42 thus preventing outward scattering of toner scraped down in the cleaning housing 101.

Under the aforesaid main blade 105, a cleaning roller 107 is provided with most parts thereof being disposed within the cleaning chamber 103 while a part thereof protrudes into the storage 104. The cleaning roller 107 is rotatably supported by the cleaning housing 101 and is in contact with the circumferential surface of the photoconductive drum 42 through the aforesaid opening 101*a* to be rotated in association with the rotation of the photoconductive drum 42. In the figure, the photoconductive drum 42 is rotated clockwise, and so the cleaning roller 107 is rotated counterclockwise. The cleaning roller 107 displaces toner or paper particle adhered to the circumferential surface of the photoconductive drum 42 over the same surface, so that the main blade 105 may easily scrape off the toner or the like off the circumferential surface of the photoconductive drum 42.

The upper part 102*a* of the aforesaid partition 102 is secured to an upper part of the cleaning housing 101, while the lower edge 102*b* thereof is in close proximity to the circumferential surface of the cleaning roller 107. To enhance the ability of the cleaning roller 107 conveying toner, a clearance S between the lower edge 102*b* of the aforesaid partition 102 and the circumferential surface of the cleaning roller 107 is preferably set in a range from 1 to 2 mm, more particularly from 1.3 to 1.5 mm. By defining such a narrow clearance S, conveying pressure of toner conveyed through the clearance S may be augmented. Accordingly, even when, as shown in FIG. 5, the accumulation of toner in the storage 104 becomes higher than the lower edge 102*b* of the partition 102*b*, the cleaning roller 107 can smoothly convey toner in the cleaning chamber 103 to the storage 104 through the clearance S. This avoids unwanted accumulation of toner in the cleaning chamber 103, thereby maintaining an excellent cleaning ability for a long period of time. With the cleaning roller 107 serving as a transport roller having a sufficient conveying ability, the structure is made simpler, smaller and less expensive than that providing a separate transport member.

Under a position where the aforesaid cleaning roller 107 is in close proximity to the lower edge 102*b* of the partition 102, an inclined scraper 108 has the upper edge thereof abut against the circumferential surface of the cleaning roller 107. The scraper 108 is secured to a mounting element 109, which is supported by a detachable lid member 111 constituting a part of the bottom of the cleaning housing 101. The lid member 111 has the aforesaid receptive blade 106 mounted thereto. The aforementioned scraper 108 separates the cleaning chamber 103 from the storage 104 by abutting against the cleaning roller 107.

In the storage 104, at a place near the cleaning chamber 103, provided is a sectionally L-shaped transport paddle 112 for advancing toward the depth of the storage 104 (leftward in the figure), toner which is conveyed from the cleaning chamber 103 into the storage 104. The transport paddle 112 is rotated in a clockwise direction as viewed in the figure thereby conveying the toner.

The operation of the cleaning unit 45 will be described. Referring to FIG. 5, in the cleaning unit 45, toner scraped off by the main blade 105 into the cleaning chamber 103 is allowed to drop onto the upper part of the cleaning roller 107 to be conveyed through the aforesaid clearance S into the storage 104 according to the rotation of the cleaning roller 107, and further onto the upper surface of the scraper 108. The toner on the scraper 108 is conveyed to the deeper side of the storage 104 by the transport paddle 112 to accumulate gradually in the storage 104. In response to this, the detecting plate 125 is carried up by the upper surface of the accumulated toner, to continue rising as inclined normally.

Figure 7A:
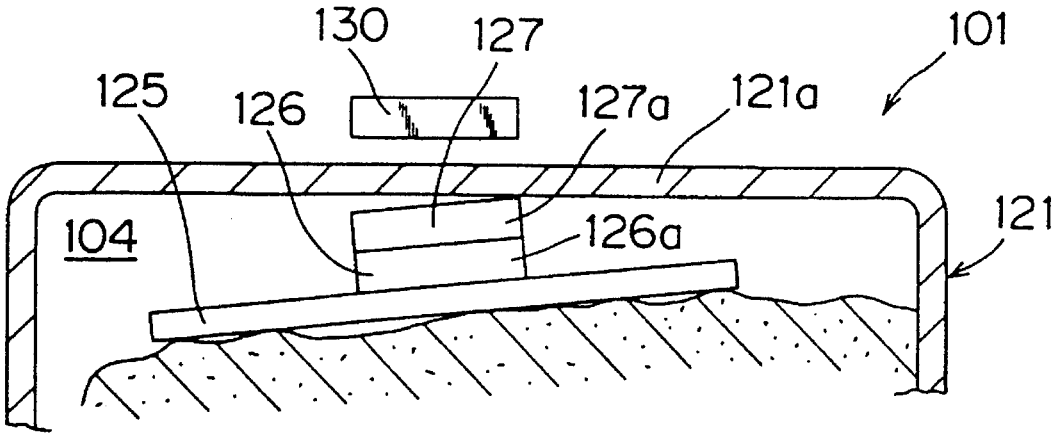
FIGS. 7A and 7B are schematic views in section illustrating a state just before detection of the fullness of the toner collecting box and a state when the fullness of the box has been detected respectively.
Figure 7B:
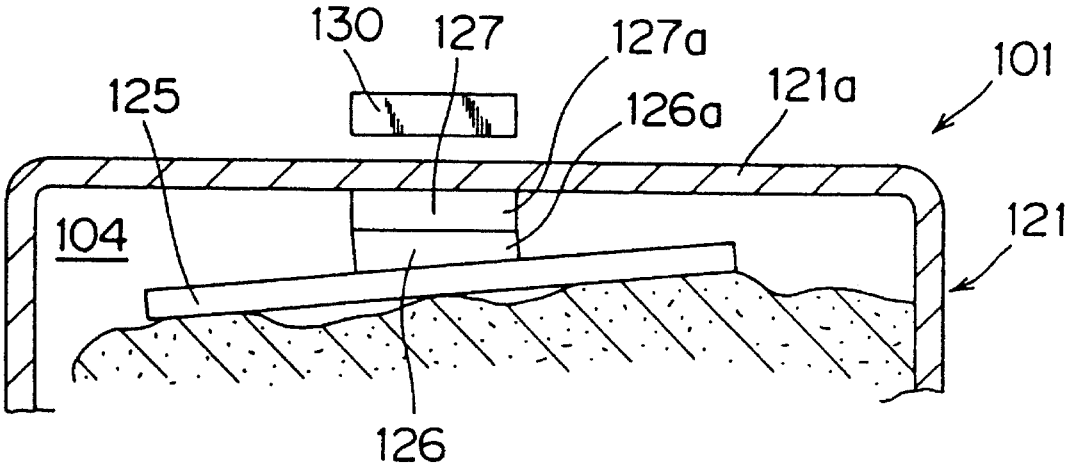

Just before the storage 104 is filled up, an end 127*a* of the permanent magnet 127 touches the lower surface of the top plate 121*a*, as shown in FIG. 7A. If the detecting plate 125 in this state is further carried up by the increasing toner accumulation, an end 126*a* of the sponge member 126 supporting the aforesaid end 127*a* of the permanent magnet 127 is compressed as shown in FIG. 7B, allowing the permanent magnet 127 to restore its horizontal position. According to the embodiment of the present invention, even if the toner waste accumulates unevenly in the storage 104, the inclination of the detecting plate 125 is balanced by the sponge member 126 so that the permanent magnet 127 can squarely oppose the reed switch 130 in a horizontal position along the top plate 121*a*. This assures detection of the fullness of the storage. Additionally, the repulsive force of the aforesaid compressed end 126*a* of the sponge member 126 causes a momentum to rotate the detecting plate 125 counterclockwise as viewed in FIG. 7B. This helps return the detecting plate 125 to a horizontal position, thereby leveling off the upper surface of the accumulated toner.

The sponge member 126 may be replaced by an elastic rubber member or a coiled compression spring having a predetermined level of elasticity. Alternatively, the detecting plate 125 may be hung from the top plate 121*a* by means of cord or wire.

The aforesaid control unit 150 comprises a microcomputer or the like, primarily controlling the drive of the optical system 3, the image processing portion 4 and the paper transport portion 5. The control unit 150 further comprises a non-volatile memory (not shown), which stores the aforesaid cumulative number of produced copies N.

Figure 8:
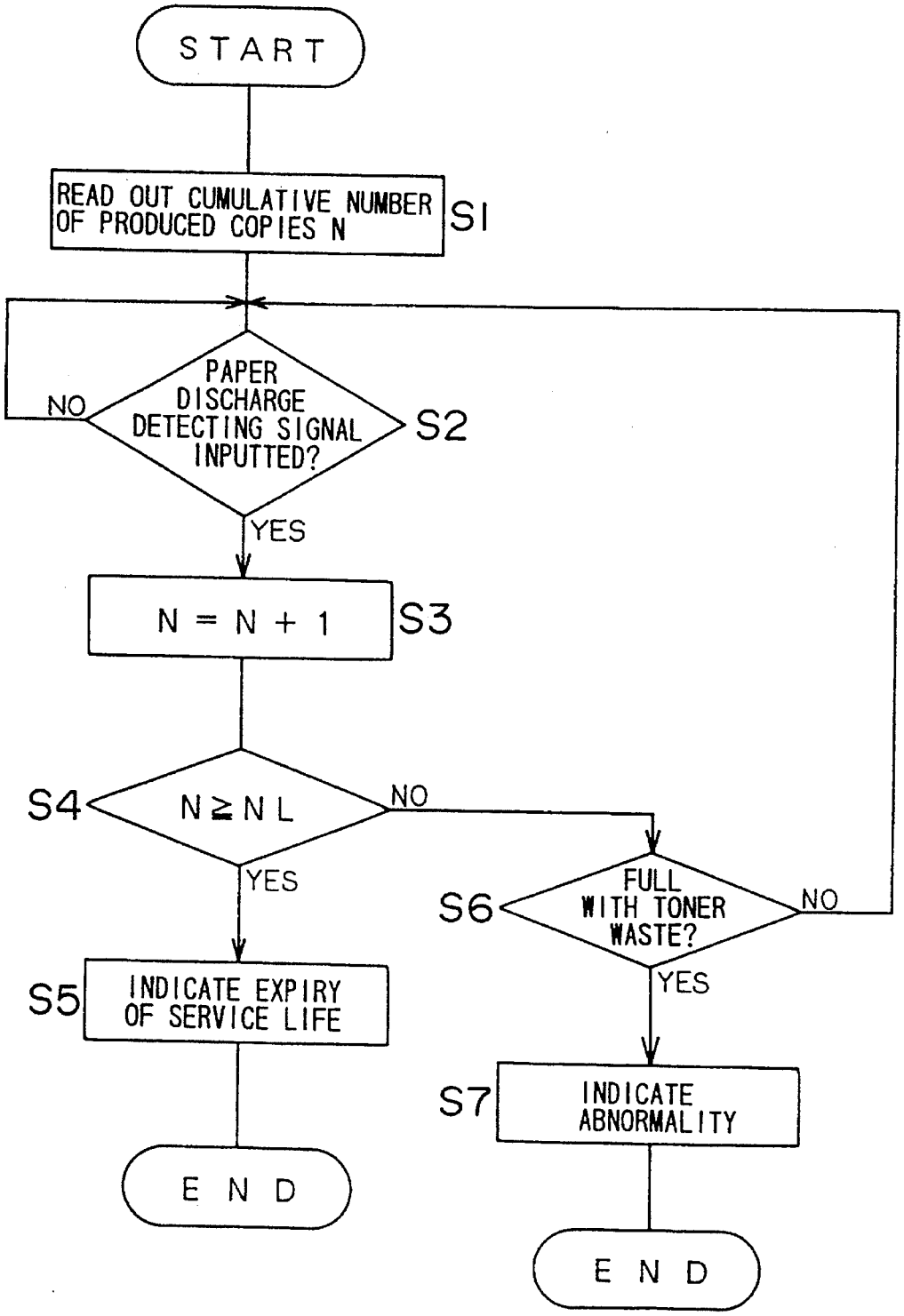
FIG. 8 is a flow chart illustrating the control flow.

Nextly with reference to FIG. 8, the process at the control unit 150 will be described. When the power source is turned on, the cumulative number of produced copies N is first read out from the aforesaid non-volatile memory (Step S1) and one is added to the cumulative number of produced copies N in response to a signal from the paper discharge detecting sensor 140 which is output each time an image is transferred onto a copy sheet (Steps 52, 53). When the cumulative number of produced copies N reaches a predetermined limit value NL, the control unit 150 orders display of a message indicating the expiry of the service life of the photoconductive drum 42 (Steps S4, S5). If the reed switch 130 detects that the storage 104 is filled up with toner waste before the expiry of the service life of the photoconductive drum 42, the control unit 150 causes the display unit 10 to indicate that the use of toner is abnormally large (Steps S6, S7).

According to the embodiment of the present invention, the storage 104 of toner waste has such a capacity that the storage does not become full before the expiry of the service life of the photoconductive drum 42 under normal operational conditions, and therefore, it is ensured that the exchange of the photoconductive drums 42 and the disposal of collected toner waste can be conducted at the same time.

In addition, from a fact that although the storage 104 has such a capacity that it should not become full before the expiry of the service life of the photoconductive drum 42 under normal operational conditions, if the storage 104 has become full before the expiry of the same, the control unit 150 judges that the use of toner is abnormally large (it can be presumed, for example, that graphic originals are used much more frequently than normal) and provides its judgment to the operator. In response to this, the operator can take a proper measure, e.g., calling a service man.

The aforesaid embodiment of the present invention determines the expiry of the service life of the photoconductive drum 42 merely based on the cumulative number of produced copies N regardless of the size of copy paper. For more accurate judgment of the expiry of the service life, however, it may be determined with the cumulative number of produced copies N and the longitudinal length of the copy paper (for example, B4 paper has twice the length of B5 paper) taken into consideration. In this case, the length of the paper is determined by the length of time interval between ON and OFF of the signal of the paper discharge detecting sensor 140.

The above described embodiment is intended to be a mere exemplification for clarifying the principles of the present invention, and is not to be construed to limit the scope of the invention. Accordingly, the spirit and scope of the present invention is to be limited only by the scope of the accompanying claims.

What is claimed is:

1. An image forming apparatus utilizing a photoconductive material having a predetermined service life, said apparatus comprising:

a toner collecting box in which toner waste removed by cleaning from said photoconductive material after image transfer is collected, said collecting box having a capacity exceeding the maximum volume of toner that would be used under normal conditions by the time that the service life of said photoconductive material expires;

life expiry detecting means for detecting the expiration of the service life of said photoconductive material;

fullness detecting means for detecting when said toner collecting box is full of toner; and abnormality warning means for indicating an abnormality when said fullness detecting means detects that said toner collecting box is full before said life expiry detecting means detects the expiration of the service life of said photoconductive material.

2. The image forming apparatus as set forth in claim 1 wherein said life expiry detecting means includes paper exit detecting means which outputs a signal in response to the exit of a copy paper from a main body of said image forming apparatus, and means for calculating a cumulative number of produced copies N in response to a signal from said paper exit detecting means.

3. The image forming apparatus as set forth in claim 1 wherein said fullness detecting means comprises:

a detecting plate which is swingably and vertically movably carried within said toner collecting box and is upwardly movable and pushed up by toner waste accumulating in said toner collecting box, a permanent magnet provided on the upper surface of said detecting plate to come in contact with a top plate of said toner collecting box when said detecting plate is elevated to a predetermined height, resilient support means interposed between said detecting plate and said permanent magnet while allowing relative inclination of said detecting plate and said permanent magnet, and a reed switch disposed above said top plate and adapted to be turned on by the magnetic force of said permanent magnet when said permanent magnet has reached a position to abut said top plate.

* * * * *